US006139077A

United States Patent [19]

Molzan, II

[11] Patent Number: 6,139,077

[45] Date of Patent: Oct. 31, 2000

[54] GUTTER CLEANING APPARATUS

[76] Inventor: Ronald A. Molzan, II, 716 Hoyt St., Michigan City, Ind. 46360

[21] Appl. No.: 09/480,351

[22] Filed: Jan. 10, 2000

[51] Int. Cl.[7] ..... E04D 13/076

[52] U.S. Cl. ..... 294/19.1; 15/236.04

[58] Field of Search ..... 294/19.1, 22, 23, 294/50.8, 50.9, 103.1, 104; 15/105, 236.04; 56/333, 334

[56] References Cited

U.S. PATENT DOCUMENTS

| | | | |
|---|---|---|---|
| D. 369,962 | 5/1996 | Moore | D8/51 |
| 1,914,246 | 6/1933 | Entrikin | 294/19.1 |
| 3,601,835 | 8/1971 | Morgan | 294/19.1 X |
| 4,057,276 | 11/1977 | Curric | 294/19 R |
| 4,114,938 | 9/1978 | Strader | 294/19 |
| 4,310,940 | 1/1982 | Moore | 15/105 |
| 4,930,824 | 6/1990 | Matthews et al. | 294/19.1 |
| 5,626,377 | 5/1997 | Carroll et al. | 294/19.1 |
| 5,853,209 | 12/1998 | McDermott | 294/19.1 |
| 5,855,402 | 1/1999 | Maraschiello | 294/19.1 |

*Primary Examiner*—Johnny D. Cherry
*Attorney, Agent, or Firm*—R. Tracy Crump

[57] ABSTRACT

An apparatus for removing leaves and debris from a roof gutter from a ground position is disclosed. The apparatus includes an adjustable articulate head unit connected to a telescoping handle. The head unit includes a pair of gripping blades hinged together along their proximal end to pivot between an open and closed position. One of the gripping blades is rotatably connected to a flat neck by an O-shaped grommet, which allows the gripping blades to rotate between different angular positions with respect to the neck for different angles of inclination. A cord is connected to the other gripping blade and passes through the grommet and is used to manually close the gripping blades. A trigger device, which includes a finger loop is secured to the cord and can be selectively positioned along its length.

19 Claims, 10 Drawing Sheets

GUTTER CLEANING APPARATUS

This invention relates to an apparatus for cleaning leaves and debris from eaves and gutters, and specifically an apparatus which enables a user to effectively clean debris from gutters, while standing on the ground.

BACKGROUND OF THE INVENTION

The accumulation of leaves and debris in roof gutters prevents the flow of runoff water from the roof and the weight of the debris can damage and break the gutters. Cleaning leaves and debris from roof gutters is a routine activity particularly in the autumn months. Typically, cleaning a roof gutter requires a person to climb onto the roof of a building or climb a ladder to the height of the gutter and then manually remove the leaves and debris from the gutter by hand or with some hand held scraper. The height at which gutters are positioned even in single story buildings makes manually cleaning gutters inherently dangerous. A person can easily fall when stooping over from the roof or leaning from a ladder to reach the gutter. Using a ladder to reach the gutters requires the ladder to be constantly repositioned to clean the entire length of the gutter.

Various gutter cleaning tools and apparatus have been developed to assist a user in the removal of leaves and debris from roof gutters from a ground position. Some of these apparatus simply employ a rake or blade mounted to an elongate pole with a mechanism for adjusting the angle of inclination between the head part and the pole. Other apparatus incorporate means for selectively extending the pole to different lengths. Many of the conventional gutter cleaning apparatus include a head unit that employs an articulated gripping mechanism to grasp and remove, as well as, rake and gather the debris within the gutter. With a gripping mechanism, the apparatus can be used to deposit debris directly into a collection container without scraping the debris onto the ground thereby lessening the work involved in gutter cleaning.

For example, U.S. Pat. No. 4,114,938 (Strader) shows a gutter cleaning device that includes an elongated pole and a pair of selectively retractable gripping arms pivotally attached to the upper end of the pole. Two U-shaped bails are rotatably attached in a juxtaposed relation to the upper end of the pole. Each gripping arm is mounted to one end segment of the U-shaped bails. The other ends of the bails are connected by a length of cord so that the user can pull the cord to rotate the bails and move the gripping arms between an open and closed position. U.S. Pat. No. 4,057,276 (Currie) shows a similar gutter cleaning apparatus that uses a pair of scoops pivotally mounted at the upper end of a pole, and a cord for selectively pivoting the scoops together to collect debris therein. In Currie '276, the cord is connected to each scoop so that when pulled the scoops are drawn together. U.S. Pat. No. 5,853,209 (McDermott) shows another improvement to a basic articulated rake or blade design for a gutter cleaning apparatus. McDermott '209 includes two clamping jaws mounted atop a telescoping tubular pole, but adds a mounting plate connecting the clamping jaws and the pole, which allows adjustment to the angle of inclination between the jaws and the pole. Again in McDermott '209, the jaws are drawn together by a cord.

Heretofore, none of the conventional gutter cleaning apparatus has adequately addressed the need for a simple and effective tool, which can be easily manipulated and adjusted while employing an articulated gripping mechanism. Typically, the cord and pulley systems of the conventional gripping mechanism have been too complicated, cumbersome and difficult to use to be practical and commercially successful. They also require that the user hold the pole in one hand while operating the cord with the other hand. In operation, collected debris can interfere with the cord and pull systems and prevent the actuation of the gripping mechanism. The need for adjusting the angle of inclination between the head unit and the pole further complicates and encumbers the gripping mechanisms. The cord and pulley systems of the conventional apparatus are not only mechanically complicated and cumbersome, but heavy. As the length of the pole increases to reach gutters at greater heights, the additional weight of the gripping mechanism makes the apparatus even more difficult to manipulate. Consequently, there remains a need for a simple and effective gutter cleaning apparatus, which includes an articulated gripping mechanism and angular adjustment while also addressing the short comings of the prior art.

SUMMARY OF THE INVENTION

The gutter cleaning apparatus of this invention enables a user to effectively clean debris from gutters, while standing on the ground. The apparatus of this invention combines both an articulated gripping mechanism and angular adjustment in a simple mechanism design, which is light weight and easily manipulated and operated. Consequently, the apparatus lessens the work and risk of cleaning roof gutters.

The gutter cleaning apparatus of this invention includes an adjustable articulate head unit connected to a telescoping handle. The head unit includes a pair of gripping blades hinged together along their proximal end to pivot between an open and closed position. A spring is used to bias the gripping blades apart into an open position. One of the gripping blades is rotatably connected to the flat neck by an O-shaped grommet, which allows the gripping blades to rotate between different angular positions with respect to the neck for different angles of inclination. A length of cord is used to manually close the gripping blades. The cord is connected to the other gripping blade and passes through the grommet. Manually pulling the cord through the grommet and downward along the handle draws the gripping blades together into their closed position. A trigger device, which includes a finger loop is secured to the cord and can be selectively positioned along its length.

Accordingly, an advantage of this invention over the prior art is that the apparatus combines both an articulated gripping mechanism and angular adjustment in a simple mechanism design.

Another advantage of this invention is that an O-shaped grommet is used to provide an angular adjustment between the gripping mechanism and the handle part and to facilitate the use of a cord as a mechanically simple gripping mechanism.

Another advantage of this invention is that the grommet rotatably connecting the neck and one of the gripping blades provides an automatic angular self adjustment mechanism.

Another advantage of this invention is that, with the cord passing through the central opening of the grommet, any angular adjustment of the blades with respect to the pole does not affect the length of the cord or the operation of the gripping mechanism.

Another advantage of this invention is that the articulated gripping mechanism can be manipulated and operated with one finger while the user holds and works the apparatus with both hands.

Another advantage of this invention is that the gripping blades can be used to scrap debris along the length of the gutter with the blades in either their open or closed position.

Another advantage of this invention is that the apparatus allows a user to clean leaves and debris from the roof gutter at various heights and angles while standing on the ground.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to best explain the invention so that others skilled in the art might utilize its teachings.

Figure 1:
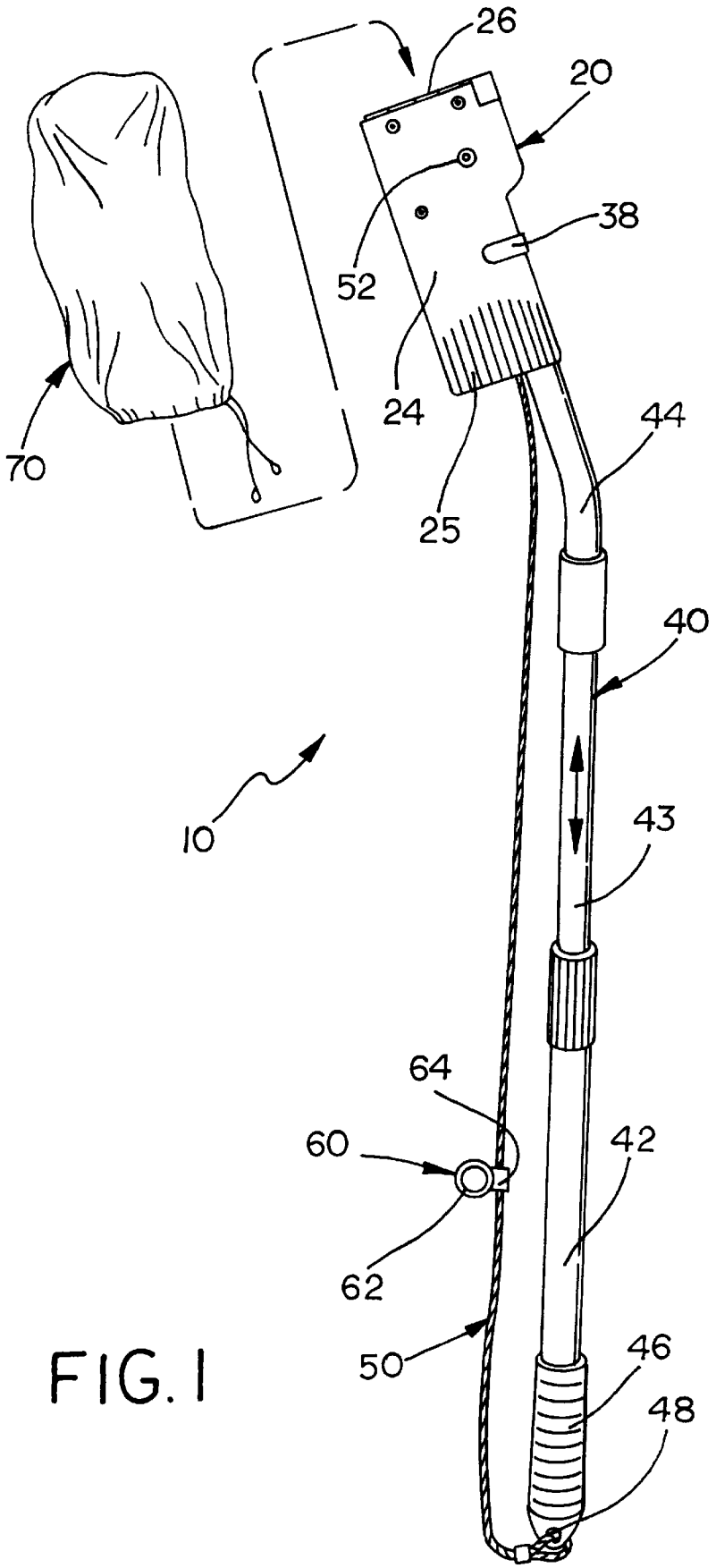
FIG. 1 is a perspective view of the apparatus of this invention shown with the head unit in its storage position and a head unit cover.

FIG. 1 shows the hand-held gutter cleaning apparatus 10 of this invention including an adjustable articulate head unit 20, an elongated pole or handle 40, a length of cord 50, trigger 60 and protective head covering 70. The figures illustrate head unit 20 as an integrated part of apparatus 10 connected to handle 40. It should be noted that head unit 20 can be adapted for use as a separate attachment part connectable to any pole or handle part without deviating from the scope of this invention.

Handle 40 is shown as having a telescoping body of any conventional design, which allows the length of the handle to be selectively varied, although an elongated pole or handle can be employed. As shown, the telescoping body includes lower section 42, a middle section 43 and a bent upper section 44. Middle section 43 is extensibly disposed within the lower section 42. The lower section 42 has a grip 46 where the operator grasps the apparatus.

Figure 10:
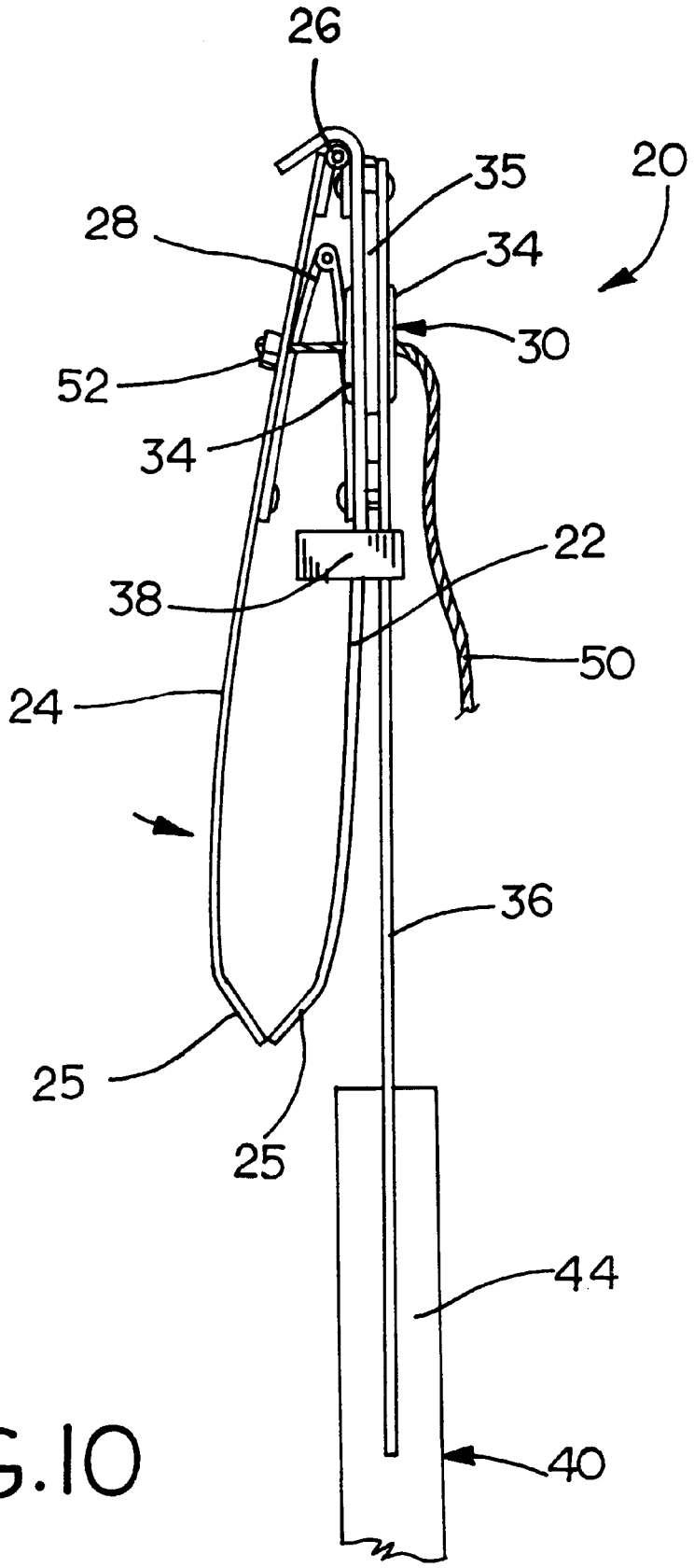
FIG. 10 is an end view of the head unit of the apparatus with the head unit pivoted to its storage position with the blades closed together.

As best shown in FIGS. 2 and 6–9, head unit 20 includes a pair of gripping blades 22 and 24, a leaf hinge 26, a spring 28, an O-shaped or annular grommet 30 and a flat bar or neck 36, which connects the head unit to handle 40. As shown in FIGS. 2 and 6–9, gripping blades 22, 24 are connected along their proximal end by hinge 26 to pivot between a closed position with the distal edge of the blades abutting and an open position with the distal edge of the blades spaced apart. Spring 28 is connected between the inner faces of blades 22, 24 to bias the distal end of the blades apart. Blades 22, 24 have a generally rectangular shape cut from a sheet of resilient metal, which is suitable to prevent folding, bending and deformation such as stainless steel, spring steel, aluminum and rigid plastic. It is essential that the blades be rigid so that they do not bend or yield against the debris being collected. Blade 24 has a plurality of parallel longitudinal slits extending from the distal edge, which form tines or fingers 25. Fingers 25 assist in the grasping of debris when the blades are drawn together. As best shown in FIG. 10, each blade 22, 24 has a slight longitudinal bend such that the outer faces are convex and the opposed inner faces of each blade are concave. In the closed position of FIG. 10, the middle of the blades bow outward due to the curvature of the opposed blades.

As shown, spring 28 is a simple leaf spring, but any conventional spring mechanism can be substituted. Furthermore, while the blades are illustrated herein constructed of metal and employing a metal leaf hinge, the construction of these head unit components may employ any suitable material or construction without altering the scope of this invention. For example, both the blades and the hinge may be constructed alternatively as a single piece of suitable plastic separated by a thin deformable section of material, which creates the connecting hinge component.

Figure 2:
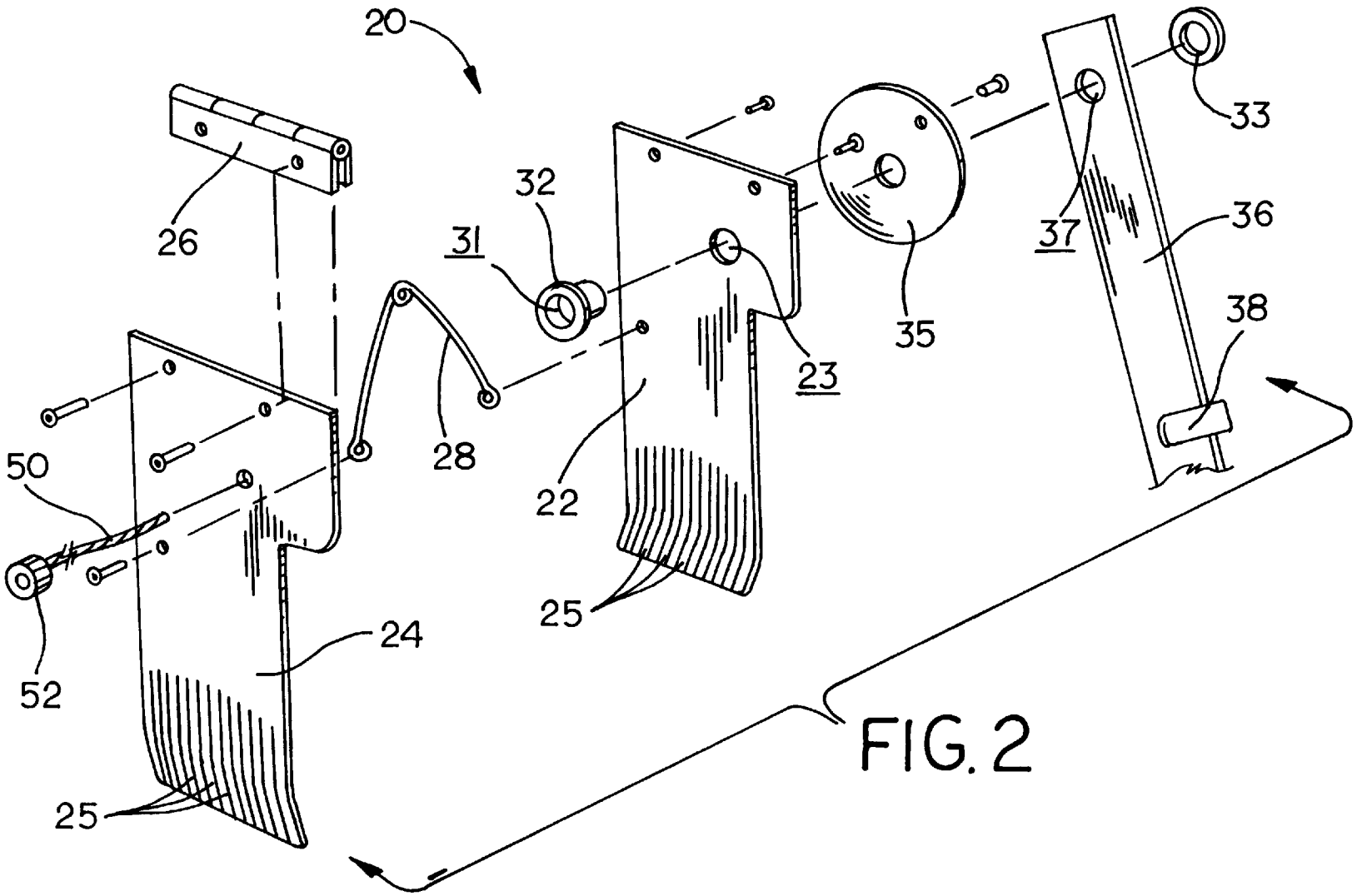
FIG. 2 is an exploded view of the head unit of the apparatus.
Figure 6:
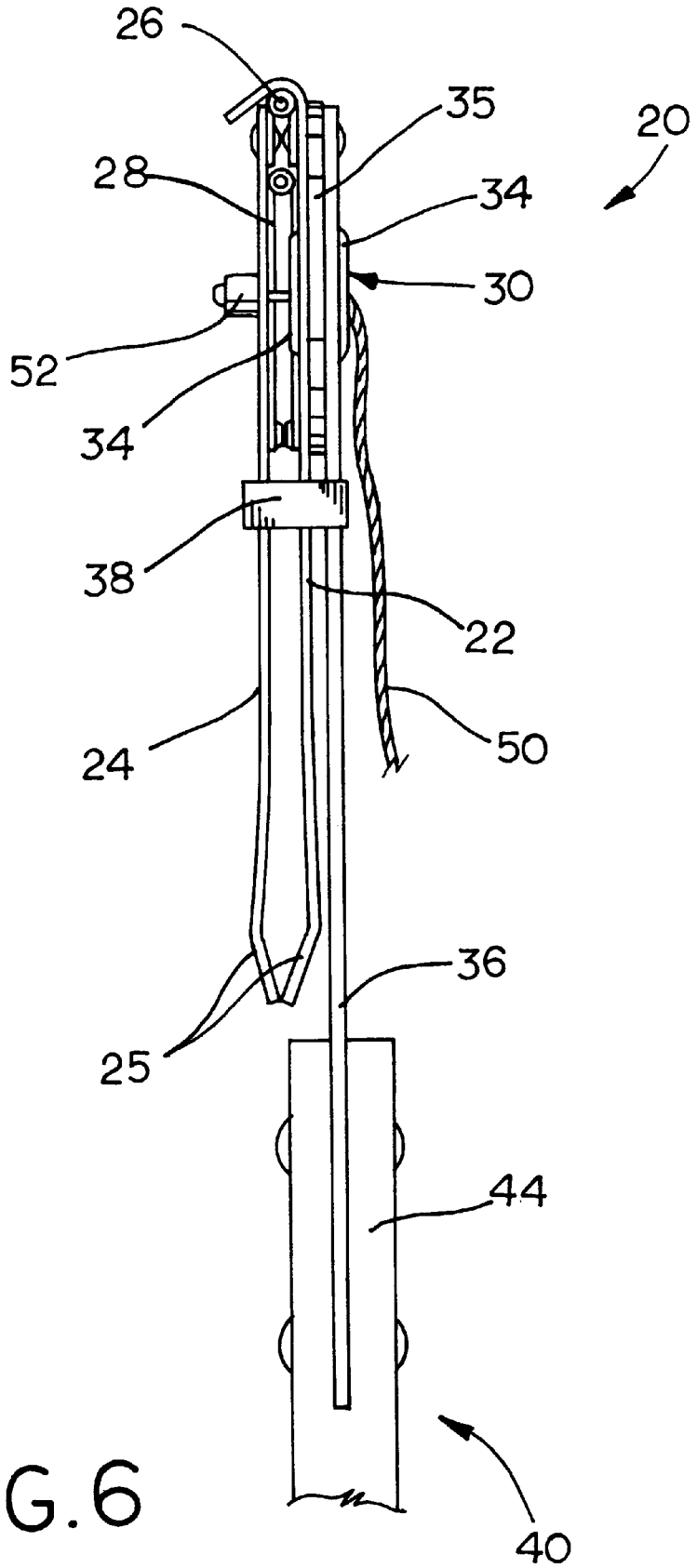
FIG. 6 is an end view of the head unit of the apparatus with the head unit pivoted to its storage position.
Figure 7:
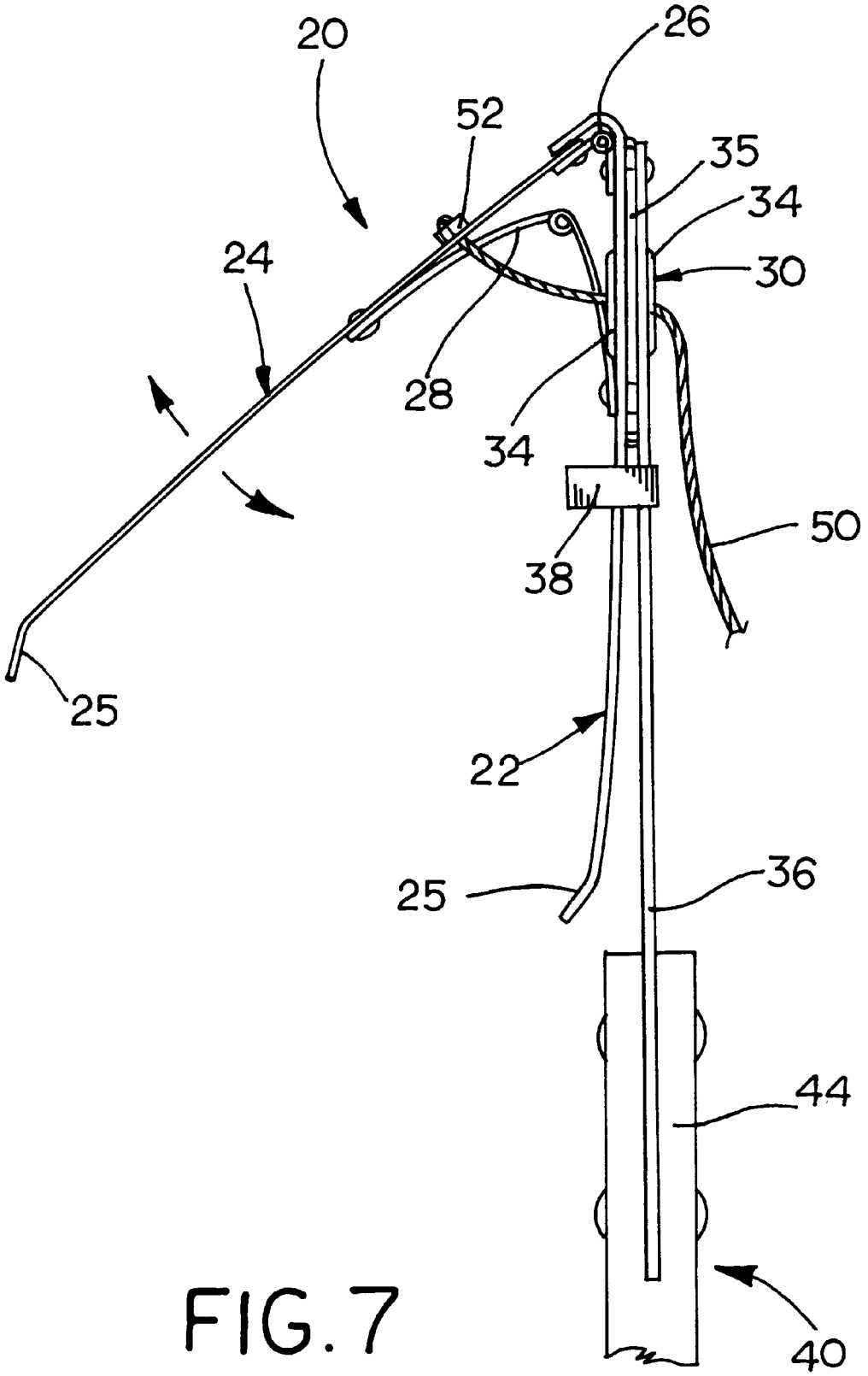
FIG. 7 is an end view of the head unit of the apparatus with the blades spaced apart in an open position.
Figure 8:
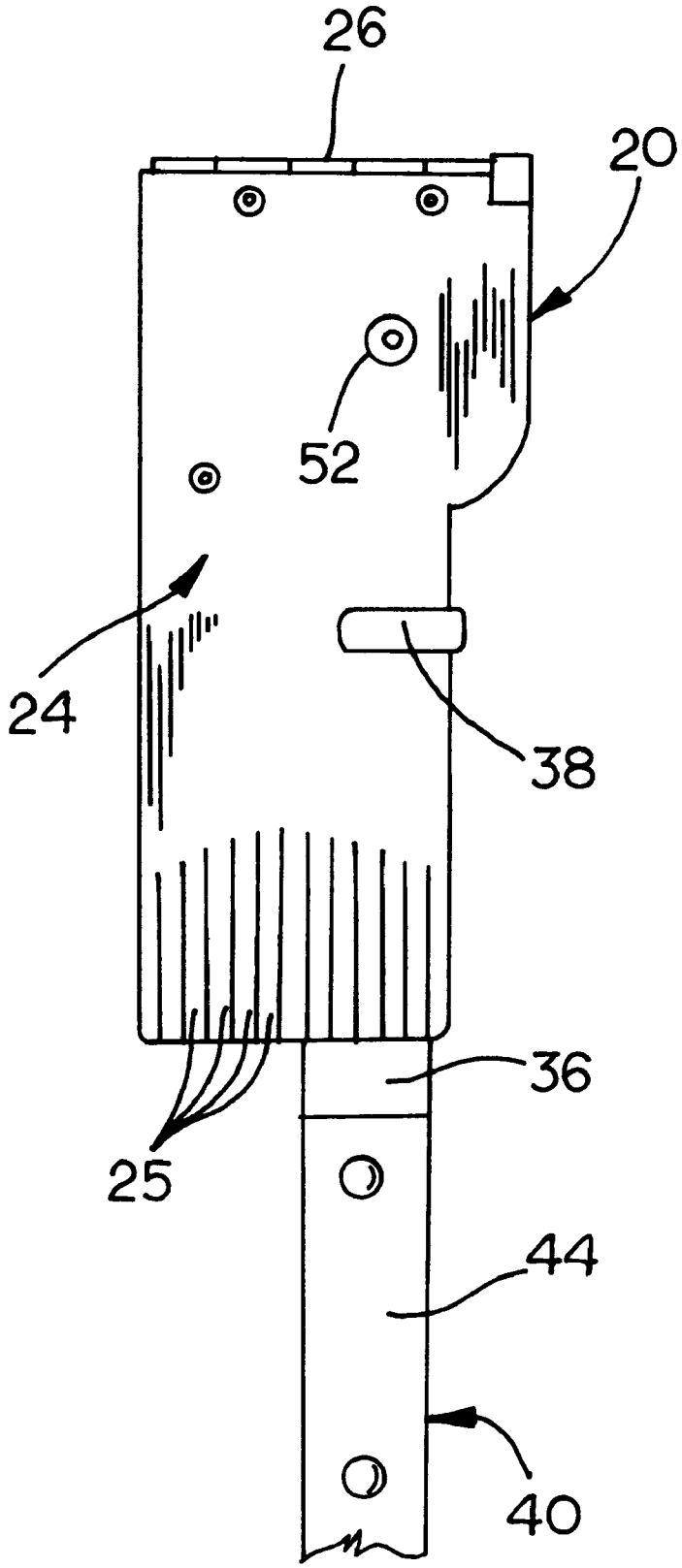
FIG. 8 is a side view of the head unit of the apparatus with the head unit pivoted to its storage position.
Figure 9:
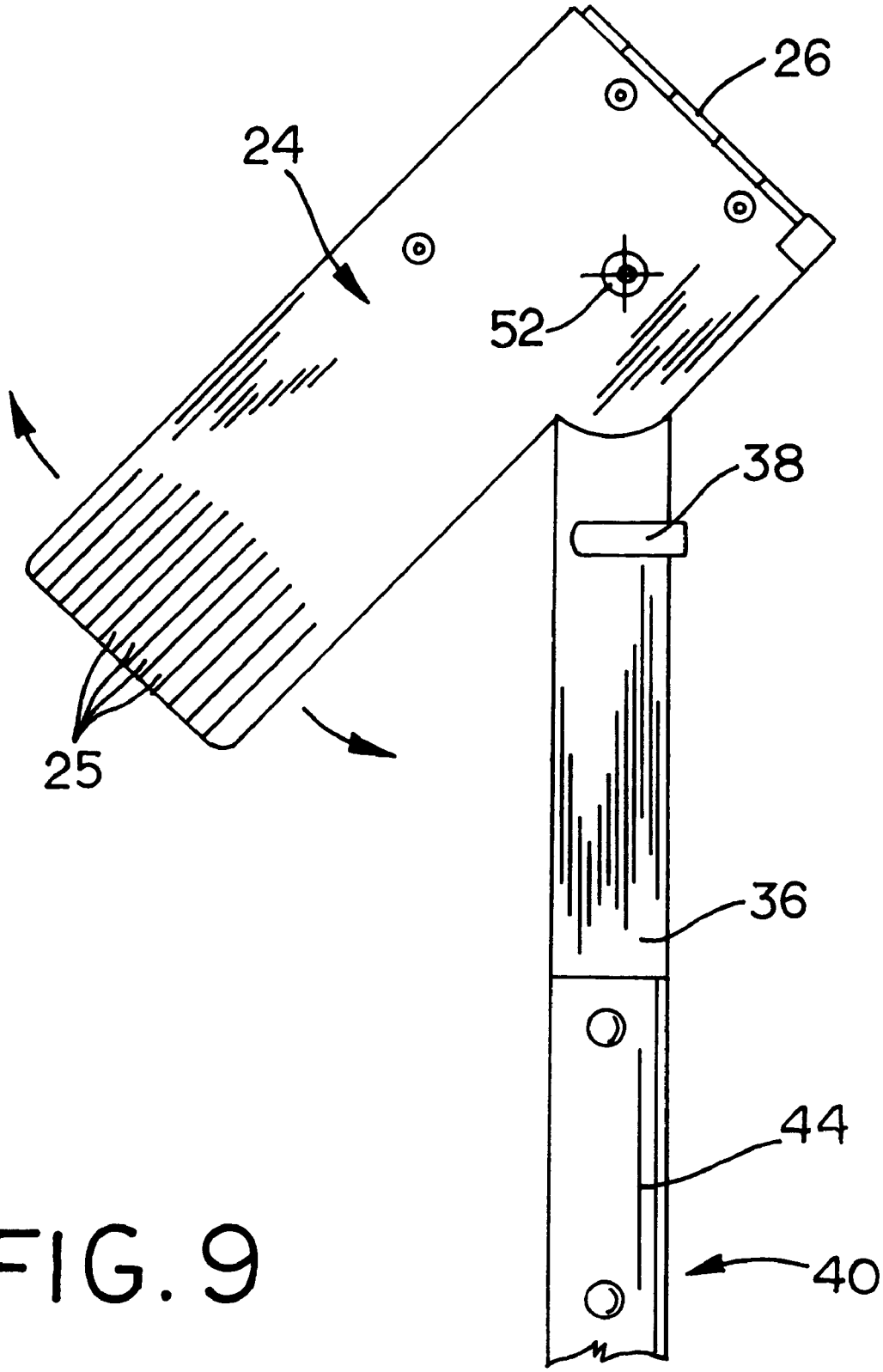
FIG. 9 is a side view of the head unit of the apparatus with the head unit pivoted to an operational position.

Gripping blade 22 is rotatably connected to neck 36 by grommet 30 to provide different angles of inclination between the gripping blades and handle 40. Grommet 30 acts as a bushing allowing blades 22, 24 to rotate between different angular positions with respect to neck 36. As shown in the figures, grommet 30 is located near the upper end of the blade 22, such that the axis of rotation provided by the grommet does not pass through the center of mass of blade part 22. As shown in FIG. 2, grommet 30 is constructed of main eyelet part 32, which extends through traverse throughbores 23 and 37 located adjacent the proximal ends of blade 22 and neck 36 respectively, and a back part 33, which is deformed on the eyelet part. When secured together, both ends of grommet 30 are deformed outwardly to form end flanges 34, which retain blade 22 and neck 36 together. The diameter of grommet 30 is substantially equal to the diameter of bores 23, 37 in blade 22 and neck 36. A disc-shaped spacer 35 of nylon or any suitable material is inserted between gripping blade 22 and neck 36 to reduce friction. As shown, grommet 30 has a central opening 31. Neck 36 has a U-shaped band 38 connected adjacent its distal end, which is used to secure head unit 20 in a storage position. In the storage position, as shown in FIGS. 6 and 10, gripping blades 22, 24 in their closed position are rotated so that the side edge of the blades abut the back of band 38 with the end of the band preventing the blades from opening.

Cord 50 is used to manually open and close gripping blades 22, 24. Cord 50 is formed of a length of any suitable string or cord. Cord 50 passes through the opening 31 in grommet 30 with one end connected to blade 24 and the other end connected to the distal end of handle 40. As shown, one end of cord 50 extends through a bore in blade 24 and terminates in a button 52, which secures that end to the blade. The opposite end of cord 50 passes between blades 22, 24 and through grommet 30 and is tied to an eyelet 48 at the distal end of handle 40. Blades 22, 24 are drawn together into their closed position by manually pulling cord 50 through grommet 30 and downward along handle 40. Because cord 50 passed through opening 31 in grommet 30, the angular orientation of the blade with respect to neck 36 and handle 40 can be adjusted without entangling the cord or affecting the ability to open and close the blades. It should be noted that the length of cord 50 is sufficient to allow for the full extension of handle 40. A trigger device 60 is secured to cord 50. Trigger 60 includes a finger loop 62 and a clip mechanism 64 to secure the trigger to the cord at selected positions along its length. The clip mechanism may employ any conventional means for selectively securing the trigger to the cord, such as a spring clamp.

Figure 3:
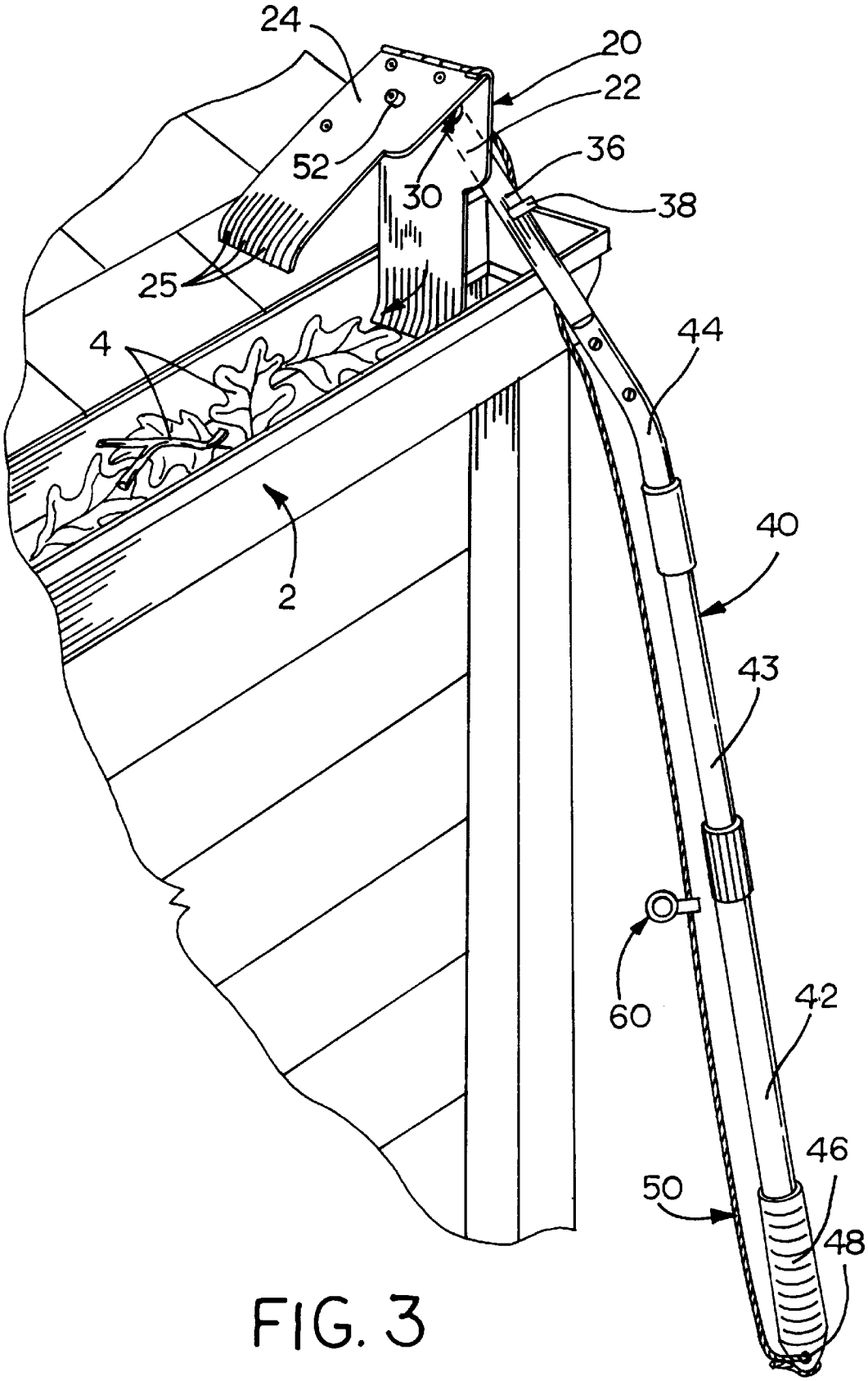
FIG. 3 is an illustration of the apparatus scooping leaves from a gutter with the head unit in an open position.
Figure 4:
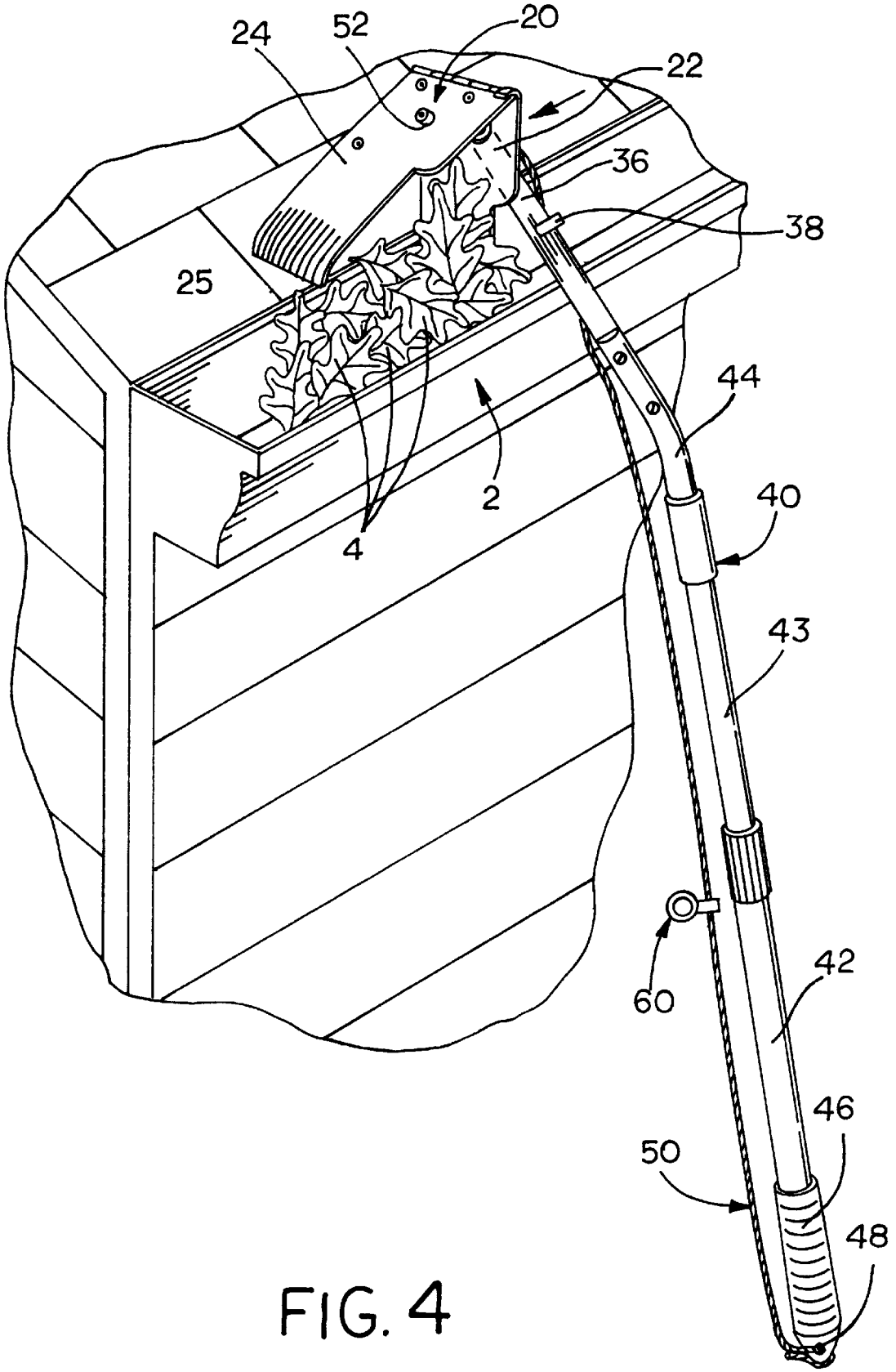
FIG. 4 is another illustration of the apparatus scooping leaves from a gutter with the head unit in an open position.
Figure 5:
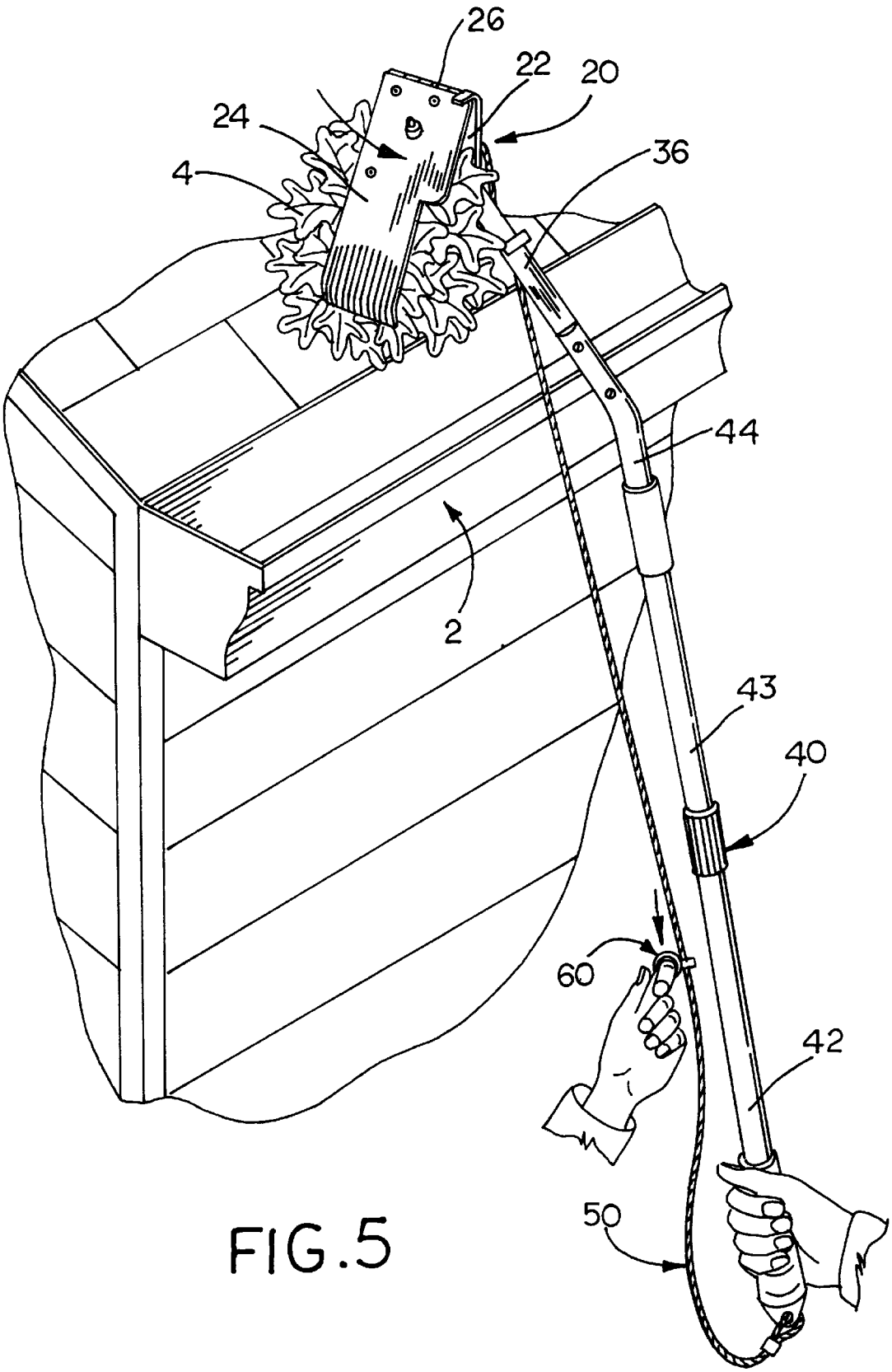
FIG. 5 is an illustration of the apparatus grasping leaves from a gutter with the head in a closed position.

FIGS. 3–5 illustrates the use of apparatus 10 to clean leaves and debris 4 from a roof gutter 2. Before use, the length of handle 40 is adjusted to accommodate the height of roof gutter 2. Next, trigger 60 is selectively positioned along the length of cord 50 to be readily accessible to the user's desired finger when grasping apparatus 10 with both hands. The user grasps handle 40 with both hands, one at the distal end and the other hand in a central position along the handle. Blades 22, 24 are rotated from their storage position into their open operational position. In the operational position, blades 22, 24 are rotated about neck 36 away from the storage band 38, which allows the blades to open. In the open operational position, blades 22, 24 are biased apart by the force of spring 28. The user raises apparatus 10 and inserts blades 22, 24 down into the gutter. The user then works apparatus 10 along the length of gutter 2 using the gripping blades to scrape the leaves and debris 4 down the length of the gutter. Gripping blades 22, 24 can be used in either the closed or open positions to scrape and collect debris 4. Once sufficient debris has been gathered, the user pulls cord 50 downward, drawing blades 22, 24 together to grasp a volume of the debris. With the cord drawn down, the user can lift head unit 20 and the gathered debris 4 out of the gutter and place the debris in a collection vessel, such as a trash bag or bin (not shown). Releasing cord 50, opens blades 22, 24 to deposit the collected debris into the collection vessel.

Advantages and Features

One skilled in the art will recognize several advantages of the design and operation of apparatus 10. First, the use of a grommet to rotatably connect one of the gripping blades and neck with the cord passing through the grommet greatly simplifies the gripping and angular adjustment mechanisms. The simple but novel design reduces the complexity and overall weight of the head unit. Second, the use of the grommet enables the gripping mechanism provided by the hinged blades and attached cord to be operatively independent of the angular adjustment mechanism. Regardless of the angular orientation, the throw of cord required to close the blades remains constant. In addition, passing the cord through the grommet, and thereby the blade's axis of rotation, prevents the cord from becoming entangled by the blades or components or debris as the blades turn about the grommet. Third, the off-centered location of the axis of rotation provided by the grommet allows the blade's angle of inclination to self adjust. Blades inherently rotate about the grommet under gravity to orientate vertically irrespective of the angular orientation of the handle part. Consequently, the blades remain vertically oriented during use even if the user stands at various distances lateral to the gutter. Fourth, the use of a trigger and the short throw required to close the blades enable the apparatus to be manipulated with both hands while a single finger is used to close the blades.

From the foregoing, it will be appreciated that the rotation of the head unit about the neck and handle is independent of the simple closing mechanism of the blades. This enables the apparatus to be quickly positioned for use at a variety of locations and angles. Since the head unit can be rotated to conform to any angular position with the handle, the operator can use the apparatus from various distances on the ground to the gutter, while the handle remains in a natural and optimal orientation. While these features are provided by specific mechanical constructions described herein and illustrated in the figures, the teachings of this invention are not limited to any particular mechanical constructions for providing these functions. For example, as illustrated and shown herein, an O-shaped grommet is used to provide for angular adjustment of the head unit while also allowing the cord to pass through the opening therein. Although a grommet is illustrated any suitable O-shaped component may be substituted to perform the same function. Furthermore, other suitable hinge means may be employed for the double leaf hinge pivotally connecting the blades. It is understood that the above description does not limit the invention to the details given, but may be modified within the scope of the following claims.

I claim:

1. An apparatus (10) for removing leaves and debris from a roof gutter from a ground position, comprising:

an elongated pole (40) having an proximal end and a distal end, and an articulated head unit connected to the proximal end of the pole, first and second blade parts (22, 24) each substantially elongated rectangular in shape, means (26) for connecting the first and second blade parts along their upper ends to allow hinged movement of the first and second blade parts between an open position where their lower ends are spaced apart and closed position where their lower ends are face to face, means (28) mounted between the first and second blade parts for biasing the first and second blade parts into their open position, a grommet (30) rotatably connecting the first blade part and the pole for permitting rotation of the first and second blade parts about the upper end of the pole between a storage position and a plurality of operational positions to adjust the angle of inclination between the pole and the first blade parts, and a length of cord (50) having one end connected to the second blade part and the other end extending through the grommet, and thereby the first blade part and neck part, whereby pulling the other end of the cord draws the first and second blade parts into their closed position.

2. The apparatus of claim 1 wherein the grommet rotatably connects the first blade part to the pole, such that the location of the axis of rotation provides means for vertically aligning the first blade part independently of the angular orientation of the pole to the first blade part.

3. The apparatus of claim 2 wherein the first and second blade parts are juxtaposed to and in axial alignment with the neck part when in their storage position.

4. The apparatus of claim 3 wherein the neck part includes a U-shaped tab for securing the first and second blade parts in their storage position.

5. The apparatus of claim 1 wherein the pole includes a elongated upper neck part (36), the grommet rotatably connects the first blade part to the neck part.

6. The apparatus of claim 1 wherein the pole include telescoping means for selectively extending the pole to one of a plurality of extended positions.

7. The apparatus of claim 1 and means (60) selectively connectable along the length of the cord for allowing a user to pull the cord with one finger while gripping the pole with both hands.

8. The apparatus of claim 1 wherein the first and second blade parts are curved about their longitudinal axis.

9. The apparatus of claim 1 wherein the lower end of one of the first and second blade parts includes a plurality of longitudinal fingers (25).

10. An head unit attachment (20) adapted for connection to an elongated pole and used for removing leaves and debris from a roof gutter from a ground position, comprising:

an elongated neck part (36) for connecting the head unit attachment to the pole, first and second blade parts (22, 24) each substantially elongated rectangular in shape, means (26) for connecting the first and second blade parts along their upper ends to allow hinged movement of the first and second blade parts between an open position where their lower ends are spaced apart and closed position where their lower ends are face to face, means (28) mounted between the first and second blade parts for biasing the first and second blade parts into their open position, a grommet (30) rotatably connecting the first blade part and the neck part for permitting rotation of the first and second blade parts about the upper end of the neck part between a storage position and a plurality of operational positions to adjust the angle of inclination between the neck part and the first blade parts, and a length of cord (50) having one end connected to the second blade part and the other end extending through the grommet, and thereby the first blade part and neck part, whereby pulling the other end of the cord draws the first and second blade parts into their closed position.

11. The apparatus of claim 10 wherein the grommet rotatably connects the first blade part to the neck part, such that the location of the axis of rotation provides means for vertically aligning the first blade part independently of the angular orientation of the neck part to the first blade part.

12. The apparatus of claim 10 wherein the first and second blade parts are juxtaposed to and in axial alignment with the neck part when in their storage position.

13. The apparatus of claim 12 wherein the neck part includes a U-shaped tab for securing the first and second blade parts in their storage position.

14. The apparatus of claim 10 and means (60) selectively connectable along the length of the cord for allowing a user to pull the cord with one finger while gripping the pole with both hands.

15. The apparatus of claim 10 wherein the first and second blade parts are curved.

16. The apparatus of claim 10 wherein the lower end of one of the first and second blade parts includes a plurality of longitudinal fingers (25).

17. An apparatus (10) for removing leaves and debris from a roof gutter from a ground position, comprising:

an elongated pole (40) and an articulated head unit connected to the upper end of the pole, the head unit includes an elongated neck part (36) having one end connected to the upper end of the pole, first and second blade parts (22, 24) each substantially elongated rectangular in shape, hinge (26) for connecting the first and second blade parts along their upper ends to allow hinged movement of the first and second blade parts between an open position where their lower ends are spaced apart and closed position where their lower ends are face to face, spring (28) mounted between the first and second blade parts for biasing the first and second blade parts into their open position, a grommet (30) rotatably connecting the first blade part and the other end of the neck part for permitting rotation of the first and second blade parts about the upper end of the neck part between a storage position and a plurality of operational positions to adjust the angle of inclination between the neck part and the first blade parts and such that the location of the axis of rotation provides means for vertically aligning the first blade part independently of the angular orientation of the neck part to the first blade part, and a length of cord (50) having one end connected to the second blade part and the other end extending through the grommet, and thereby the first blade part and neck part, whereby pulling the other end of the cord draws the first and second blade parts into their closed position.

18. The apparatus of claim 1 wherein the neck part includes a U-shaped tab for securing the first and second blade parts in their storage position.

19. The apparatus of claim 1 and a trigger part (60) selectively connectable along the length of the cord for allowing a user to pull the cord with one finger while gripping the pole with both hands.

* * * * *